US009371719B2

(12) United States Patent
Underdown

(10) Patent No.: US 9,371,719 B2
(45) Date of Patent: Jun. 21, 2016

(54) CONTROLLING PRESSURE DURING PERFORATING OPERATIONS

(71) Applicant: David Underdown, Conroe, TX (US)
(72) Inventor: David Underdown, Conroe, TX (US)
(73) Assignee: Chevron U.S.A. Inc., Houston, TX (US)

( * ) Notice: Subject to any disclaimer, the term of this patent is extended or adjusted under 35 U.S.C. 154(b) by 254 days.

(21) Appl. No.: 14/197,879
(22) Filed: Mar. 5, 2014
(65) Prior Publication Data
US 2014/0299322 A1 Oct. 9, 2014

Related U.S. Application Data
(60) Provisional application No. 61/809,959, filed on Apr. 9, 2013.

(51) Int. Cl.
*E21B 43/11* (2006.01)
*E21B 43/116* (2006.01)
*E21B 43/119* (2006.01)

(52) U.S. Cl.
CPC ..... *E21B 43/116* (2013.01); *E21B 43/1195* (2013.01)

(58) Field of Classification Search
CPC . E21B 43/116; E21B 43/117; E21B 43/1185; E21B 43/263
See application file for complete search history.

(56) References Cited

U.S. PATENT DOCUMENTS 3,029,732 A * 4/1962 Greene ..... E21B 33/1243 102/310
4,683,943 A * 8/1987 Hill ..... E21B 43/267 166/177.5
4,823,875 A * 4/1989 Hill ..... E21B 43/267 166/280.1
4,976,318 A * 12/1990 Mohaupt ..... E21B 37/08 166/311
7,913,603 B2 * 3/2011 LaGrange ..... E21B 43/1185 166/373
8,079,296 B2 * 12/2011 Barton ..... E21B 43/1185 175/4.56
8,336,437 B2 12/2012 Barlow et al.
8,555,764 B2 * 10/2013 Le ..... E21B 43/117 102/310
8,807,003 B2 8/2014 Le et al.
9,080,430 B2 * 7/2015 Al Busaidy ..... E21B 43/114
2004/0231840 A1 11/2004 Ratanasirigulchai
2006/0196665 A1 * 9/2006 LaGrange ..... E21B 43/1185 166/298
2010/0000789 A1 * 1/2010 Barton ..... E21B 43/1185 175/2
2010/0147587 A1 6/2010 Henderson
2011/0000669 A1 * 1/2011 Barlow ..... E21B 43/117 166/297
2011/0011587 A1 * 1/2011 Al Busaidy ..... E21B 43/114 166/297

(Continued)

FOREIGN PATENT DOCUMENTS

WO WO 2010141671 12/2010
WO WO 2011163252 12/2011
WO WO 2012154180 11/2012

OTHER PUBLICATIONS

International Search Report for PCT/US2014/020708, mailed Nov. 13, 2014.

*Primary Examiner* — Jennifer H Gay
(74) *Attorney, Agent, or Firm* — King & Spalding LLP

(57) ABSTRACT

A method for controlling pressure in a wellbore during a perforating operation can include positioning a perforating tool within the wellbore, where the perforating tool comprises a gun and an energetic chamber. The method can also include igniting an energetic within the energetic chamber to generate a propellant. The method can further include igniting at least one charge within the gun, where the at least one charge is ignited toward a wall of the wellbore adjacent to the gun. The method can also include directing the propellant from the energetic chamber into the gun.

20 Claims, 5 Drawing Sheets

(56) References Cited

U.S. PATENT DOCUMENTS

2011/0209871 A1* 9/2011 Le ..... E21B 43/117
166/297
2013/0118745 A1 5/2013 Grove
2014/0299322 A1* 10/2014 Underdown ..... E21B 43/116
166/297

* cited by examiner

CONTROLLING PRESSURE DURING PERFORATING OPERATIONS

CROSS-REFERENCE TO RELATED APPLICATIONS

This application claims priority under 35 U.S.C. §119 to U.S. Provisional Patent Application Ser. No. 61/809,959, titled "Controlling Pressure During Perforating Operations" and filed on Apr. 9, 2013, the entire contents of which are hereby incorporated herein by reference.

TECHNICAL FIELD

The present disclosure relates generally to controlling pressure during perforating operations.

BACKGROUND

Perforating operations can be performed in a wellbore that has been drilled or otherwise created in a subterranean formation. Perforating operations create some sort of trauma (e.g., explosion, penetration) to the wellbore and penetrate into the subterranean formation. Such perforating operations are used to extract one or more resources (e.g., oil, natural gas, water, steam) from within the subterranean formation into the wellbore. Once in the wellbore, such resources can be extracted. At times, the wellbore is cased with casing pipe, usually made of metal, to prepare the wellbore for extraction of one or more materials from the subterranean formation. In such a case, the perforating operations can penetrate both the casing pipe and the subterranean formation.

SUMMARY

In general, in one aspect, the disclosure relates to a method for controlling pressure in a wellbore during a perforating operation. The method can include positioning a perforating tool within the wellbore, where the perforating tool includes a gun and an energetic chamber. The method can also include igniting an energetic within the energetic chamber to generate a propellant. The method can further include igniting at least one charge within the gun, where the at least one charge is ignited toward a wall of the wellbore adjacent to the gun. The method can also include directing the propellant from the energetic chamber into the gun.

In another aspect, the disclosure can generally relate to a perforating tool. The perforating tool can include a gun having at least one charge, where the at least one charge is directed radially away from the gun toward a wall of a wellbore. The perforating tool can also include a cord operatively coupled to the charge and to a first control mechanism, where the first control mechanism initiates the ignition of the at least one charge using the cord. The perforating tool can further include an energetic chamber comprising an energetic. The perforating tool can also include a passage disposed between the energetic chamber and the gun, where the passage has an open position and a closed position, where the passage is in the closed position when the energetic is in a neutral state, and where the passage is in the open position when the energetic is ignited to generate a propellant. The propellant can move from the energetic chamber to the gun when the passage is in the open position.

In yet another aspect, the disclosure can generally relate to a perforating system. The perforating system can include a wellbore disposed within a subterranean formation. The perforating system can also include a first control mechanism. The perforating system can further include a perforating tool operatively coupled to the first control mechanism and disposed within the wellbore. The perforating tool can include a gun having at least one charge, where the at least one charge is directed radially away from the gun toward a wall of the wellbore. The perforating tool can also include a cord operatively coupled to the at least one charge and to the first control mechanism, where the first control mechanism initiates the ignition of the at least one charge using the cord. The perforating tool can further include an energetic chamber having an energetic. The perforating tool can also include a passage disposed between the energetic chamber and the gun, where the passage has an open position and a closed position, where the passage is in the closed position when the energetic is in a neutral state, and where the passage is in the open position when the energetic is ignited to generate a propellant. The propellant can move from the energetic chamber to the gun when the passage is in the open position.

These and other aspects, objects, features, and embodiments will be apparent from the following description and the appended claims.

BRIEF DESCRIPTION OF THE DRAWINGS

The drawings illustrate only example embodiments of controlling pressure during perforating operations and are therefore not to be considered limiting of its scope, as controlling pressure during perforating operations may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
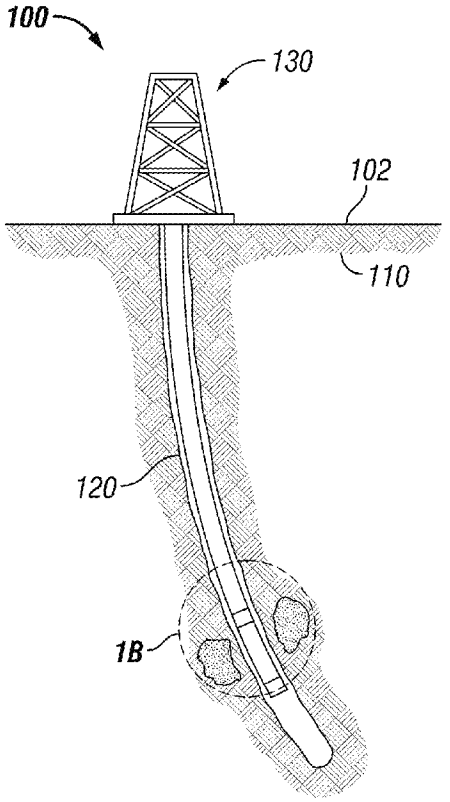
FIGS. 1A and 1B show a schematic diagram of a field system in which a perforating operation can be performed in accordance with one or more example embodiments.

Example embodiments of controlling pressure during perforating operations will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and height can each generally be described as lateral directions.

A user as described herein may be any person that interacts with an example perforating tool for controlling pressure during perforating operations. Examples of a user may include, but are not limited to, a roughneck, a company representative, a drilling engineer, a completion engineer, a tool pusher, a service hand, a mechanic, an operator, a consultant, a contractor, and a manufacturer's representative.

Figure 1B:
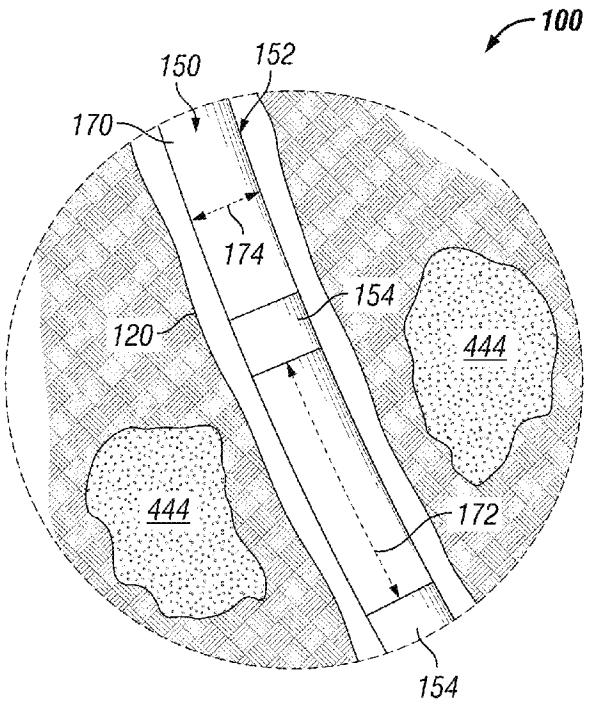

FIGS. 1A and 1B each shows a schematic diagram of a field system 100 in which controlling pressure during perforating operations in accordance with one or more example embodiments can be used. FIG. 1A shows a schematic diagram of the overall field system 100, while FIG. 1B shows a detailed view of a portion of the field system 100. In one or more embodiments, one or more of the features shown in FIGS. 1A and 1B may be omitted, added, repeated, and/or substituted. Accordingly, embodiments of a field system should not be considered limited to the specific arrangements of components shown in FIGS. 1A and 1B.

Referring now to FIGS. 1A and 1B, the field system 100 in this example includes a wellbore 120 that is formed in a subterranean formation 110 using field equipment 130 above a surface 102, such as ground level for an on-shore application and such as (for example) from a drill ship, a jack-up platform, or a semi-submersible platform for an off-shore application. The subterranean formation 110 can include one or more of a number of formation types, including but not limited to shale formations, clay formations, sand formations, sandstone formations, and salt formations. In certain embodiments, a subterranean formation 110 can also include one or more reservoirs in which one or more resources (e.g., oil, gas, water, steam) can be located. A field operation (e.g., drilling, a perforating operation) can be performed to extract such resources through the wellbore 120.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 used to create the wellbore 120 can be positioned and/or assembled at the surface 102. The field equipment 130 can include, but is not limited to, a derrick, a tool pusher, a clamp, a tong, drill pipe, a drill bit, and casing pipe. The field equipment 130 can also include one or more devices that measure and/or control various aspects (e.g., direction of wellbore 120, pressure) of a field operation associated with the wellbore 120. For example, the field equipment 130 can include a wireline tool that is run through the wellbore 120 to provide detailed information (e.g., formation characteristics) throughout the wellbore 120. Such information can help determine, for example, where a perforating operation should be performed within a wellbore and how much charge should be used to perform the perforating operation.

The field equipment 130 can also include one or more control mechanisms. A control mechanism can be operatively coupled to at least a portion (e.g., gun, energetic chamber) of a perforation tool. A control mechanism can initiate an ignition of an energetic and/or charge of a perforation tool. A control mechanism can initiate the ignition of at least a portion of a perforation tool by sending a fixed amount of energy and/or a controlled amount of energy to the perforation tool. In any case, the energy delivered by the control mechanism can be any form of energy, including but not limited to electrical energy, hydraulic energy, and mechanical energy.

In some cases, when the wellbore has been drilled, casing 150 is inserted into the wellbore. The casing 150 can include a number of casing pipes 152 that are mechanically (e.g., threadably) coupled to each other. A coupling member 154 can be used at each end of a casing pipe 152 to enable the mechanical coupling of two casing pipes 152. Each casing pipe 152 can have a body 170 that has a length 172 and a width 174. The length 172 of the body 170 of a casing pipe 152 can vary. For example, a common length 172 of the body 170 is approximately 40 feet. The length 172 can be longer (e.g., 60 feet) or shorter (e.g., 10 feet) than 40 feet.

The width 174 can also vary and can depend on the cross-sectional shape of the body 170. For example, when the cross-sectional shape of the body 170 is circular, the width 174 can refer to an outer diameter, an inner diameter, or some other form of measurement of the body 170 of the casing pipe 152. Examples of a width 174 in terms of an outer diameter can include, but are not limited to, 5 inches, 7 inches, 7⅝ inches, 8⅝ inches, 10¾ inches, 13⅜ inches, and 14 inches. Generally, the width 174 of the casing pipe 152 decreases as the depth of the wellbore increases. Also, the width 174 of the casing pipe 152 can be approximately the same as, or slightly less than, the width of the wellbore 120 at a particular depth of the wellbore 120.

In some cases, when casing 150 is inserted into a wellbore 120, other components and/or equipment can be installed in the wellbore 120. Examples of such equipment can include, but are not limited to, packers (e.g., inflatable packer, hook-wall packer, compression-set packer), tubulars (e.g., casing 150, production tubing), and electrical devices (e.g., pumps, motors).

When a wellbore 120 is being completed, casing 150 is inserted into the wellbore 120 along with other production equipment (e.g., pump assemblies, motors). Such production equipment is used to send material 444 from within the casing 150 to the surface 102. In order for material 444 from the formation 110 to enter the casing 150, the casing 150 is perforated. The casing 150 is often perforated once the casing 150 has been inserted into the wellbore 120 and, in some cases, cemented or otherwise adhered in place within the wellbore 120 by pouring cement in the gap 280 between the wellbore 120 and the casing 150. In such a case, in addition to perforating the casing 150 (and in some cases cement or other similar material), the wellbore 120 can also be perforated to help extract the material 444 within the formation 110.

The casing 150 and/or wellbore 120 can be perforated by performing a perforating operation. A perforating operation can be performed in one or more of a number of ways. For example, a perforating tool (as shown and described below with respect to FIG. 2) can be inserted into the wellbore 120 within the casing 150. When one or more components of the perforating tool are initiated, the perforating tool creates perforations through the casing 150 and, in some cases, through some portion of the wellbore 120 into the formation 110. In such a case, materials 444 within the formation 110 can traverse along the perforations made in the formation 110 to the wellbore 120, through the perforations created in the casing 150 (and in some cases cement or other similar material), and into a cavity formed within the casing 150.

Figure 2A:
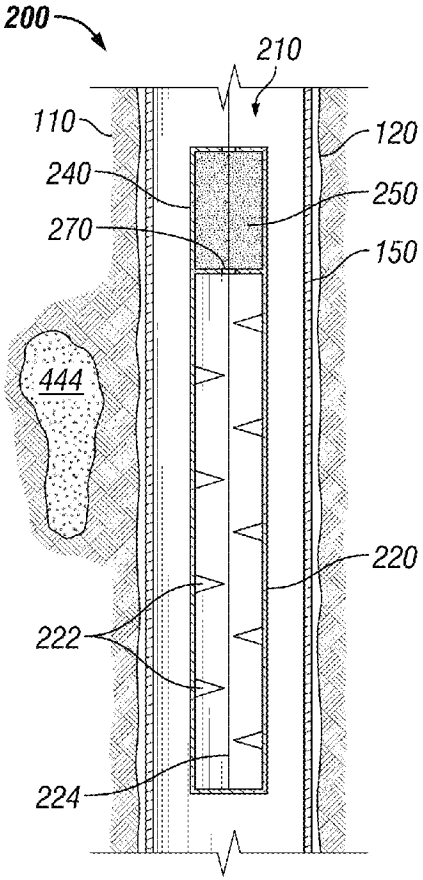
FIGS. 2A and 2B each shows a cross-sectional side view of an example perforating tool disposed in a wellbore in a subterranean field before a perforating operation in accordance with one or more example embodiments.
Figure 2B:
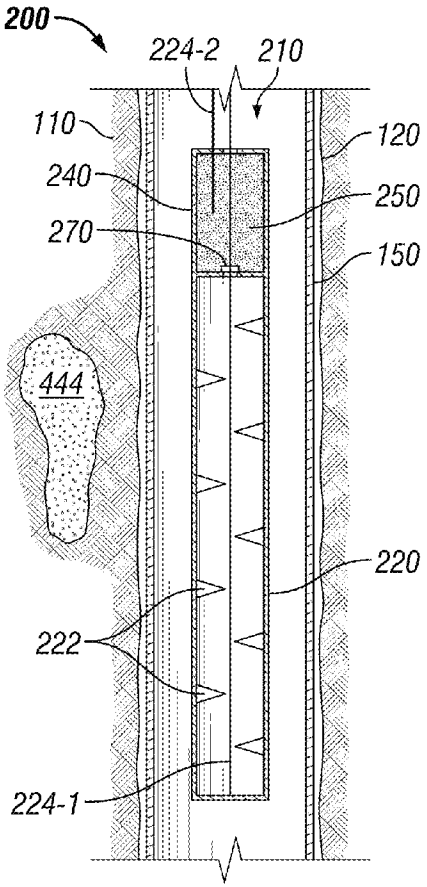

FIGS. 2A and 2B each shows a cross-sectional side view of a portion 200 of a wellbore 120 that includes an example perforating tool 210 disposed in the wellbore 120 in a subterranean formation 110 in accordance with one or more example embodiments. Specifically, the perforating tool 210 shown in FIGS. 2A and 2B is placed into the wellbore 120 (and, more specifically, within a cavity 410 formed within the casing 150) before a perforating operation is performed. In one or more embodiments, one or more of the features shown in FIGS. 2A and 2B may be omitted, added, repeated, and/or substituted. Accordingly, embodiments of a perforating tool should not be considered limited to the specific arrangements of components shown in FIGS. 2A and 2B.

Referring to FIGS. 1A, 1B, 2A, and 2B, the perforating tool 210 can include a gun 220 and an energetic chamber 240. In certain example embodiments, the perforating tool 210 is lowered into the casing 150 and positioned within the casing 150 using field equipment 130, such as, for example, a wireline. The gun 220 can be a chamber that includes one or more of a number of charges 222 (e.g., shape charges), which contain explosives designed to impact a targeted area in a targeted direction relative to the gun 220. For example, as shown in FIGS. 2A and 2B, the charges 222 can be disposed proximate to the outer wall of the gun 220 and directed radially away from the gun 220, toward a wall of the wellbore 120. The gun 220 can also include one or more of a number of other components, including but not limited to a hollow charge carrier and/or a shock absorber. Each charge 222 can contain an energetic (e.g., explosive), which may be the same or different than the energetic 250 in the energetic chamber 240, described below.

The perforating tool 210 can also include a cord 224 that is disposed inside the gun 220 and is operatively (e.g., electrically) coupled to one or more of the charges 222. The cord 224 can also be operatively coupled to one or more control mechanisms, as described above with respect to the field equipment 130 of FIG. 1. The one or more control mechanisms can initiate the ignition of the charge 222 using the cord 224. The cord 224 can be, or can be coupled to, a wireline or some other cable, electrical or mechanical, that reaches the perforating tool 210 from the surface 102.

The cord 224 can be a cable of any type (e.g., fiber optic, electrical, instrumentation) having one or more conductors capable of carrying an amount of energy (e.g., current, voltage) that is fixed and/or controlled. In other instances, the cord 224 may contain an energetic that explodes to initiate the explosive or energetic in the charges 222. In certain example embodiments, the cord 224 is omitted from the perforating tool 210, and the amount of energy delivered to the charge 222 is performed using some other means (e.g., wirelessly, using a locally placed battery) triggered using one or more of a number of devices (e.g., a timer, a sensor).

In certain example embodiments, the energetic chamber 240 of the perforating tool 210 includes an energetic 250 that is disposed within the energetic chamber 240. The energetic 250 can be a type of explosive. Examples of such an explosive can include, but are not limited to, solid fuel, potassium chlorate, potassium perchlorate, plasticized nitrocellulose, hydrates, and hydroxides. The energetic 250, while explosive, can be in a neutral state up until the perforating operation is performed.

The energetic chamber 240 can be located in one or more of a number of positions relative to the gun 220. For example, as shown in FIGS. 2A and 2B, the energetic chamber 240 can be located above the gun 220. In addition, or in the alternative, the energetic chamber 240 can be located below the gun 220. As another alternative, the gun 220 can be divided into two or more portions, where an energetic chamber 240 can be disposed between one or more portions of the gun 220.

In certain example embodiments, the cord 224 is also disposed within the energetic chamber 240. In such a case, the cord 224 can also be operatively coupled to the energetic chamber 240. The cord 224 can ignite the energetic 250 in the energetic chamber 240 to generate a propellant. Specifically, the energetic 250, when reacted with some form of energy (e.g., heat, power), creates a propellant (usually a gas) and, in some cases, a byproduct. Alternatively, an additional cord (or some other mechanism) can be used to ignite the energetic 250. The energetic 250 can also be ignited using some other components and/or methods, as described above with respect to igniting the charge 222.

In certain example embodiments, the energetic chamber 240 also includes a passage 270 disposed between the energetic chamber 240 and the gun 220. The passage 270 can have an open position and a closed position. The passage 270 can be in the closed position when the energetic 250 is in a neutral state. The passage 270 can be in the open position when the energetic 250 is ignited to generate a propellant 350, as described below with respect to FIGS. 3A and 3B.

The passage 270 can have one or more of a number of different configurations. For example, as shown in FIGS. 2B and 3B, the passage 270 can be a sliding sleeve that slides from a closed position (as shown in FIG. 2B) to an open position (as shown in FIG. 3B) upon the occurrence of an event (e.g., when a propellant is generated from the energetic). As another example, as shown in FIGS. 2A and 3A, the passage 270 can be a rupture mechanism (e.g., a disk) that ruptures (changes to an open position) upon the occurrence of an event.

Before the charges 222 of the perforating tool 210 are ignited, certain conditions within the wellbore 120 can exist. For example, the hydrostatic pressure in the wellbore 120 can be more or less than the pressure that is generated by detonation of the energetic in the charges 222 in the gun 220. The pressure generated by the detonation of the charges 222 can be determined using, for example, the type of explosive used in the charge 222 and the amount of the explosive used in the charge 222.

Figure 3A:
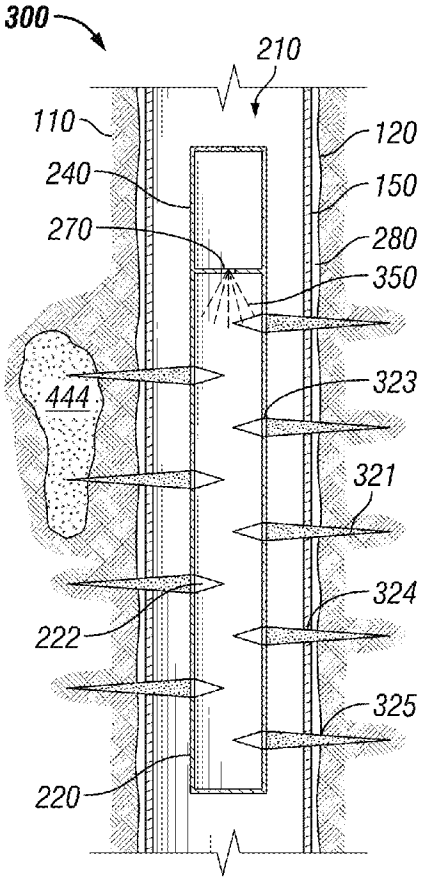
FIGS. 3A and 3B each shows a cross-sectional side view of an example perforating tool disposed in a wellbore in a subterranean field during a perforating operation in accordance with one or more example embodiments.
Figure 3B:
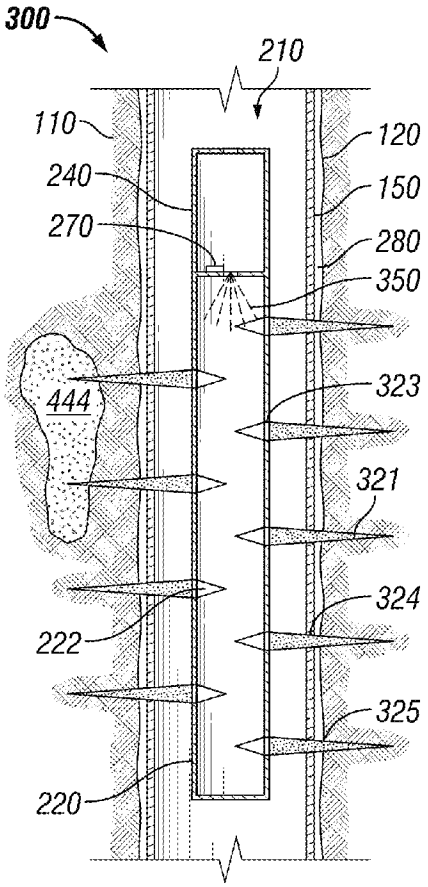

FIGS. 3A and 3B each shows a cross-sectional side view of a portion 300 of the wellbore 120 that includes the example perforating tool 210 of FIGS. 2A and 2B disposed in the wellbore 120 in a subterranean formation 110 in accordance with one or more example embodiments. Specifically, the perforating tool 210 shown in FIGS. 3A and 3B is during a perforating operation. In one or more embodiments, one or more of the features shown in FIGS. 3A and 3B may be omitted, added, repeated, and/or substituted. Accordingly, embodiments of a perforating tool should not be considered limited to the specific arrangements of components shown in FIGS. 3A and 3B.

Referring to FIGS. 1A, 1B, 2A, 2B, 3A, and 3B, the energetic chamber 240, the passage 270, and the gun 220 of the perforating tool 210 have undergone changes relative to the perforating tool 210 of FIG. 2. With respect to the gun 220, the charges 222 in FIGS. 3A and 3B are ignited, causing one or more perforation tunnels 321 to be formed adjacent to each respective charge 222. Each perforation tunnel 321 can cause a hole 323 in the outer wall of the gun 220, a hole in the cement (if applicable) in the gap 280 between the wellbore 120 and the casing 150, a hole 324 in the casing 150, and a hole 325 in the wellbore 120. The perforation tunnel 321 can extend into the formation 110 beyond the hole 325 in the wellbore 120.

If the resultant pressure inside the gun 220 is less than the hydrostatic pressure inside the wellbore 120, there is a potential for fluids from the wellbore 120 to flow into the gun 220 through the holes 323 in the outer wall of the gun 220. Such an occurrence can be called a Dynamic Underbalance (DUB). An example of a pressure (DUB) trace within a wellbore 120 during a perforating operation is shown below with respect to FIG. 5.

With regard to the energetic chamber 240, the energetic 250 is ignited, which generates a propellant 350 (usually a gas, as described above). The energetic 250 can be ignited using the same or a different control mechanism, with or without the cord 224, relative to igniting the charges 222 of the gun 220. For example, as shown in FIG. 2A, the cord 224 that is used to trigger the charges 222 also triggers the energetic 250 in the energetic chamber 240. In such a case, a single control mechanism can initiate both the charges 222 and the energetic 250. Thus, the pressure created by the propellant 350 in the gun 220 is not controlled.

As another example, as shown in FIG. 2B, the charges 222 can be ignited using one control mechanism (in this case, cord 224-1), and the energetic 250 can be ignited using a second control mechanism (e.g., a different cord 224-2 or other different triggering mechanism), where the second control mechanism (in this case, cord 224-2) delivers a controlled amount of energy to the energetic chamber 240. In such a case, for a known (constant) mass of the energetic 250, the controlled amount of energy (e.g., signal, current, voltage) delivered to the energetic chamber 240 can be directly proportional to the pressure created by the propellant 350. Thus, the pressure created by the propellant 350 in the gun 220 is controlled.

In certain example embodiments, controlling the pressure created by the propellant 350 in the gun 220 can be beneficial to strike a better balance between applying too little pressure in the gun 220 (which collapses the perforation tunnels 321) and applying too much pressure in the gun 220 (which fails to induce the material 444 to enter the wellbore 120 from the formation 110).

In addition, the passage 270 can change from a closed position to an open position, allowing the propellant 350 generated in the energetic chamber 240 to move through the passage 270 to the gun 220. In certain example embodiments, the passage 270 changes from the closed position to the open position in response to a change (increase) in pressure in the energetic chamber 240 caused by the formation of the propellant 270 from the energetic 250. In other words, the pressure in the energetic chamber 240 caused by the energetic 250 can be less than (in some cases, significantly so) the pressure in the energetic chamber 240 caused by the propellant 270.

Figure 4:
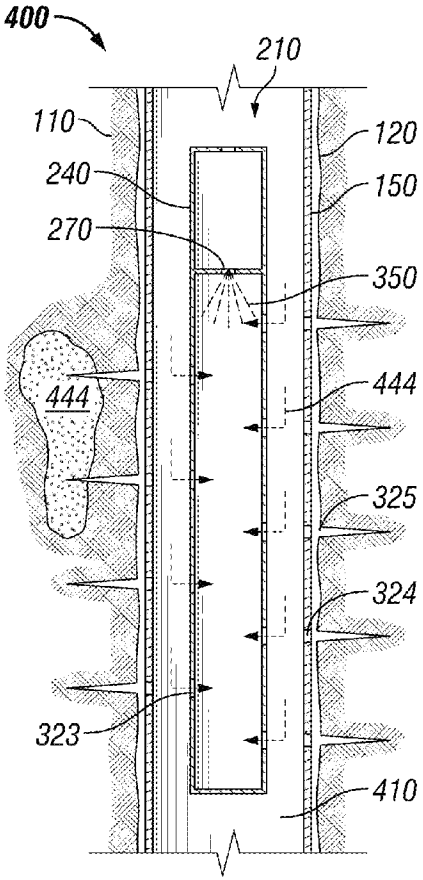
FIG. 4 shows a cross-sectional side view of an example perforating tool disposed in a wellbore in a subterranean field after a perforating operation in accordance with one or more example embodiments.

FIG. 4 shows a cross-sectional side view of a portion 400 of the wellbore 120 that includes the example perforating tool 210 of FIG. 3 disposed in the wellbore 120 in a subterranean formation 110 in accordance with one or more example embodiments. Specifically, the perforating tool 210 shown in FIG. 2 is after the perforating operation. In one or more embodiments, one or more of the features shown in FIG. 4 may be omitted, added, repeated, and/or substituted. Accordingly, embodiments of a perforating tool should not be considered limited to the specific arrangements of components shown in FIG. 4.

Referring to FIGS. 1A, 1B, 2A, 2B, 3A, 3B, and 4, the gun 220 have undergone further changes relative to the perforating tool 210 of FIG. 3. Specifically, the charges 222 of the gun 220 have fragmented. Further, materials 444 (e.g., fluids, gases) from the formation 110 have traveled through the perforation tunnels 321 created by the charges 222, through the holes 325 in the wall of the wellbore 120, through the holes 324 in the casing 150, and into the cavity 410 between the casing 150 and the gun 220.

Some amount of the materials 444 can also enter inside the gun 220 through the holes 323. The amount of the materials 444 that enter inside the gun 220 through the holes 323 can vary depending, for example, on the pressure inside the gun 220 and the free volume inside the gun 220. The lower the pressure inside the gun 220 (which corresponds to a higher DUB), the more of the materials 444 that enter inside the gun 220 through the holes 323 and into other parts of the cavity 410 within the wellbore 120. When the DUB is too high, the perforation tunnels 321 can collapse. In addition, or in the alternative, when the DUB is too high, equipment (e.g., packers, tubulars, electrical devices) that is positioned within the wellbore 120 can become damaged or destroyed. Such problems can occur within a wellbore 120 in any formation, but can be more likely to occur in a deep field or formation 110, such as is found in a deepwater completion.

At the other extreme, when a DUB is too low, the materials 444 will not be induced to leave the formation 110 through the perforation tunnels 321 because of the relatively low pressure in the wellbore 120. Thus, a balance must be achieved to create a proper pressure in the wellbore 120 (and, more specifically, in the perforating tool 210) to induce materials 444 from the formation 110 without collapsing the perforation tunnels 321 through which the materials 444 can use to enter the wellbore 120. Thus, the propellant 350 that is generated from the energetic 250, whether using a standard amount of energy or a controlled amount of energy, provides a sufficient pressure within the gun 220 to provide a DUB that is not too high or too low.

In certain example embodiments, the passage 270 changes from the open position back to the closed position when some amount of the propellant 350 has left the energetic chamber 240 (i.e., when the pressure within the energetic chamber 240 drops below a certain level or threshold pressure). Alternatively, the passage 270 remains in the open position after changing state from the closed position.

Figure 5:
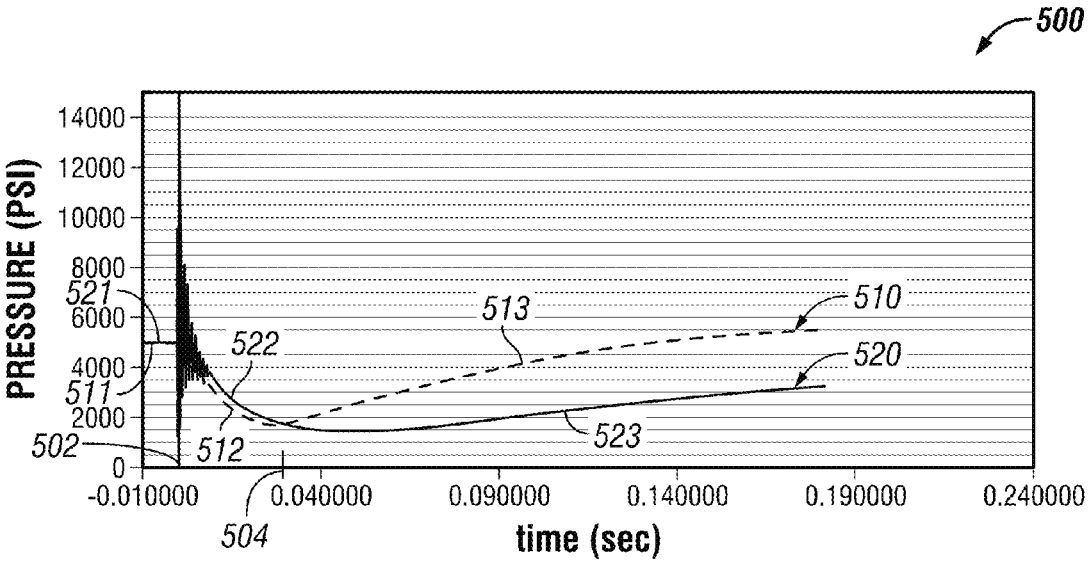
FIG. 5 shows a graph of pressure within a wellbore before, during, and after a perforating operation using an example perforating tool in accordance with one or more example embodiments.

FIG. 5 shows a graph 500 of pressure within a wellbore before, during, and after a perforating operation using an example perforating tool 210 in accordance with one or more example embodiments. In one or more embodiments, one or more of the features shown in FIG. 5 may be omitted, added, repeated, and/or substituted. Accordingly, embodiments of wellbore pressure before, during, and after a perforating operation should not be considered limited to the specific arrangements of components shown in FIG. 5. For example, the pressures shown in the graph 500 can vary based on one or more of a number of factors, including but not limited to the type of rock in the formation 110, the types of charges 222 used, the number of charges 222 used, and the thickness and/or material of the casing 150.

Referring to FIGS. 1A, 1B, 2A, 2B, 3A, 3B, 4, and 5, the graph 500 of FIG. 5 shows a natural pressure track 520 within a wellbore 120 without using example embodiments and an enhanced track 510 within the wellbore 120 using example embodiments described herein. Initially, before time 502, the pressure 521 of the natural pressure track 520 and the pressure 511 of the enhanced pressure track 510 are substantially the same. At approximately time 502, the charges 222 are ignited (detonated). Thus, between time 502 and 504, the natural pressure track 520 and the enhanced pressure track 510 undergo a small series of extreme spikes.

In this example, after the extreme spikes at time 502 have subsided, the pressure 522 of the natural pressure track 520 and the pressure 512 of the enhanced pressure track 510 reach their low pressure point of approximately 1500 psi. After time 504, the pressure 513 of the enhanced pressure track 510 is raised due to the pressure generated by the propellant 350, while the pressure 523 of the natural pressure track 520, without the benefit of the propellant 350, remains much lower than the pressure 513.

Figure 6A:
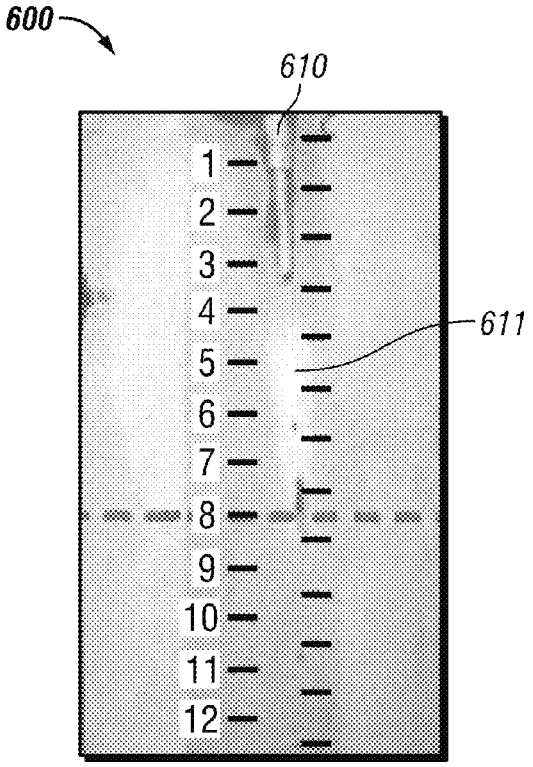
FIGS. 6A and 6B show cross-sectional side views perforation tunnels created by a perforating tool known in the art (FIG. 6A) and by an example perforating tool in accordance with one or more example embodiments (FIG. 6B).
Figure 6B:
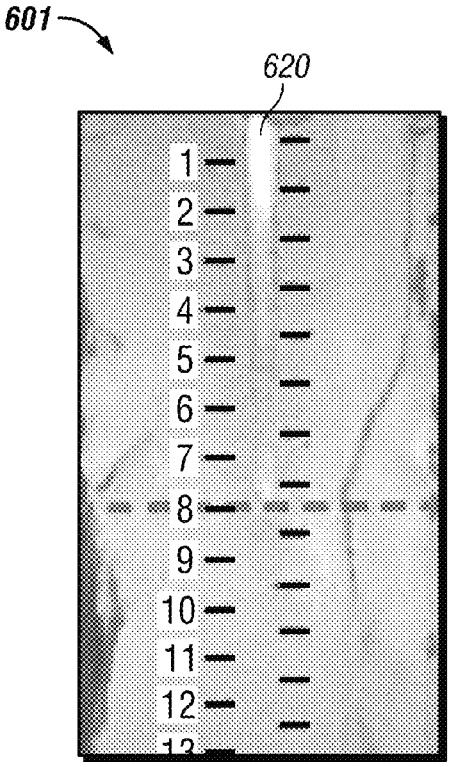

FIGS. 6A and 6B show cross-sectional side views of perforation tunnels created by a perforating tool known in the art and by an example perforating tool in accordance with one or more example embodiments. Specifically, FIG. 6A shows a cross-sectional side view 600 of a perforation tunnel 610 created by a perforating tool known in the art, and FIG. 6B shows a cross-sectional side view 601 of a perforation tunnel 620 created by an example perforating tool 210 in accordance with one or more example embodiments. In one or more embodiments, one or more of the features shown in FIGS. 6A and 6B may be omitted, added, repeated, and/or substituted. Accordingly, embodiments of perforation tunnels created by a perforating operation should not be considered limited to the specific arrangements of components shown in FIGS. 6A and 6B.

Referring to FIGS. 1A, 1B, 2A, 2B, 3A, 3B, 4, 5, 6A, and 6B, the perforation tunnel 610 of FIG. 6A is only about 3 inches, while the perforation tunnel 620 of FIG. 6B is about 8 inches long. The perforation tunnels should be equal to each other because identical charges 222 are used in an identical formation 110. However, since the perforating tool of FIG. 6A did not use an optimized DUB, the pressure within the wellbore 120 is too large, causing most of the perforation tunnel in FIG. 6A to collapse 611. By contrast, with respect to FIG. 6B, because the pressure inside the gun 220 is increased by directing the propellant 350 into the gun 220, the DUB is optimized (or, at least, increased). When the DUB is optimized or otherwise increased, the perforation tunnel 620 in FIG. 6B is cleaned out and helps to prevent the perforation tunnel 620 from collapsing.

Figure 7:
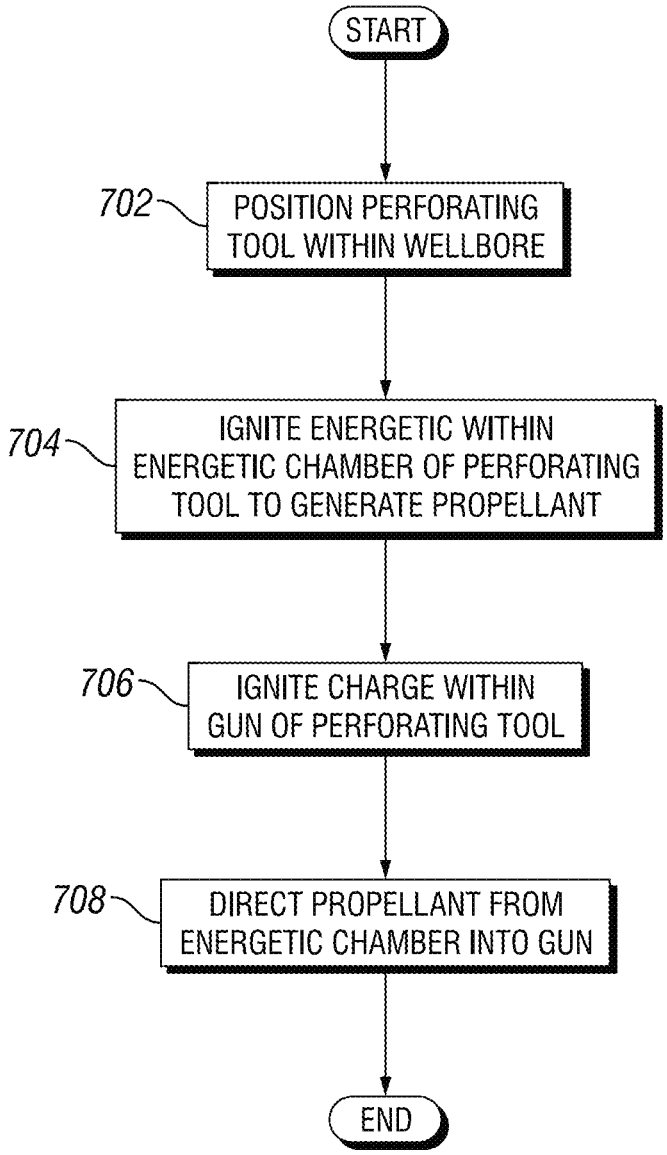
FIG. 7 shows a flow diagram for a method for controlling pressure in a wellbore in accordance with one or more example embodiments.

FIG. 7 shows a flow diagram for a method 700 for controlling pressure in a wellbore during a perforating operation in accordance with one or more example embodiments. While the various steps in this flowchart are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIG. 7, may be included in performing these methods. Accordingly, the specific arrangement of steps shown in FIG. 7 should not be construed as limiting the scope.

Referring now to FIGS. 1A, 1B, 2A, 2B, 3A, 3B, 4, 5, 6A, 6B, and 7, the example method 700 begins at the START step and continues to step 702. In step 702, a perforating tool 210 is positioned within the wellbore 120. In certain example embodiments, the perforating tool 210 includes a gun 220 and an energetic chamber 240. The perforating tool 210 can be positioned in the wellbore 120 using field equipment 130, such as a wireline.

In step 704, an energetic 250 within the energetic chamber 240 is ignited to generate a propellant 350. The energetic 250 can be ignited using a control mechanism that sends an amount of energy to the energetic chamber 240. The control mechanism can use a cord 224 to send the amount of energy to the energetic chamber 240. In such a case, the amount of energy reacts with the energetic 250 to generate the propellant 350. The amount of energy can be controlled (a controlled amount of energy) or standard (a standard amount of energy). In certain example embodiments, the amount of energy used to ignite the energetic 250 is based, at least in part, on the amount of energetic 250 in the energetic chamber 240.

In step 706, one or more charges 222 is ignited within the gun 220. In certain example embodiments, the charge 222 is ignited toward a wall of the wellbore 120 adjacent to the gun 220. The charges 222 can be ignited using a control mechanism that sends an amount of energy to the gun 220. Such a control mechanism can be the same or different than the control mechanism used to ignite the energetic 250. The control mechanism can use a cord 224 to send the amount of energy to the gun 220. In such a case, the cord 224 can be disposed in the gun 220 and operatively coupled to the control mechanism. The amount of energy delivered to the charges 222 in the gun 220 can be controlled or standard.

In certain example embodiments, the charges 222 are ignited at a point in time that is substantially the same as when the energetic 250 is ignited. Alternatively, the charges 222 can be ignited at a point in time that is before or after when the energetic 250 is ignited. When the charges 222 are ignited, one or more tunnels 321 are created, forming a hole 323 in the gun 220, hole 324 in the casing 150, and a hole 325 in the wall of the wellbore 120.

In step 708, the propellant 350 is directed from the energetic chamber 240 into the gun 220. In certain example embodiments, the passage 270 is used to direct the propellant 350 from the energetic chamber 240 into the gun 220. In such a case, the passage 270 changes from a closed position to an open position. The passage 270 can change from a closed position to an open position based on one or more of a number of factors. For example, the increase in pressure caused by the formation of the propellant 350 in the energetic chamber 240 can cause the passage 270 to change from a closed position to an open position. In such a case, the propellant 350 is directed into the gun 220 when the propellant 350 is generated from the energetic 250 in the energetic chamber 240. Directing the propellant 350 from the energetic chamber 240 into the gun 220 can increase the pressure within the gun 220. When the propellant 350 is directed from the energetic chamber 240 into the gun 220, the propellant 350 can naturally flow toward the holes 325 in the wall of the wellbore 120. When the propellant 350 is directed from the energetic chamber 240 into the gun 220, the method 700 ends at the END step.

Example

Results of a test program using example embodiments described herein are described and listed below. The objective of the test program is to compare the depth of penetration and amount of open perforation tunnel of deep penetrating (DP) and big hole (BH) charges from three different sources (companies) for completions at a site with the following formation and borehole characteristics:

| PROPERTY | VALUE |
|---|---|
| Strength | ~8000 psi |
| Permeability | 100-200 mD |
| Porosity | 20% |

-continued

| PROPERTY | VALUE |
|---|---|
| Diameter | 7 inches |
| Length | 24 inches |

The test mechanism consists of a pressure vessel that allows for the application of pressure to simulate downhole conditions of confining stress, pore pressure, and wellbore pressure. A simulated wellbore holds wellbore fluid and a laboratory perforating gun module. The core is enclosed in a rubber sleeve to prevent communication with the confining fluid, and an end plate is used to impart pore pressure. The charge is fired through a steel plate representing the casing and a cement plug representing the cement in the well before penetrating the core. The tests for this program did not involve flowing any fluids before or after the perforating event. The following test parameters apply:

| PROPERTY | VALUE |
|---|---|
| Confining Pressure | 9950 psi |
| Pore Pressure | 3950 psi |
| Simulated Well Pressure | 4900 psi |
| Effective Stress | 6000 psi |
| Simulated Casing | 3.5 inches, 9.3 ppf, L-80 |
| Cement Hardness (UCS) | ~5000 psi |
| Temperature | Ambient |
| Fluid Gap | |
| Company A | 0.25 inches |
| Company B | 0.23 inches |
| Company C | 0.32 inches |
| Test Core Fluid | Odorless Mineral Spirits |
| Pore Pressure Fluid | Odorless Mineral Spirits |
| Wellbore Fluid | Odorless Mineral Spirits |

where the difference in fluid gaps are due to differences in the guns used.

After firing each charge, the core was either scanned using computerized tomography (CAT scan) technology to obtain the length of the perforation tunnel, and/or split open to measure the length of the open perforation tunnel and total length of penetration. The following table shows a summary of the results of the testing:

| SUPPLIER | CHARGE | TOTAL PENETRATION | TOTAL OPEN PENETRATION | DUB USED? |
|---|---|---|---|---|
| Company B | 2.5", 11.1 gm, DP II | 8.1 inches | 8.1 inches | Yes |
| Company A | 2.5", 12.0 gm, DP | 10.7 inches | 9.2 inches | Yes |
| Company B | 2.375", 10 gm, Big Hole | 3.10 inches | 3.10 inches | Yes |
| Company A | 2.5", 11.2 gm, Big Hole | 1.69 inches | 1.69 inches | Yes |
| Company C | 2.5", 26.4 gm, Capsule Charge | 11.45 inches | 0.58 inches | No |
| Company B | 2.5", 11.1 gm, DP II | 6.74 inches | 1.70 inches | No |
| Company B | 2.375", 10 gm, Big Hole | 2.57 inches | 0.0 inches | No |

The experiment shows that similar gram weight charges for both the deep penetrating and big hole charges from both Company B and Company A gave comparable penetrations at the same wellbore dynamic condition (i.e., dynamically underbalanced). In addition, the 26.4 gm DP charge used by Company C provided the deepest penetration as expected based on the gram loading. Further, incorporation of an engineered dynamic underbalance (DUB) enhanced the amount of open perforation tunnel.

The systems, methods, and apparatuses described herein allow for controlling pressure within a gun that discharges one or more charges to create one or more tunnels in the formation that surrounds a wellbore. Controlling the pressure within the gun is important when extracting materials from the formation. If the pressure of the gun is too high, the materials may not be induced into the wellbore from the formation through the tunnels. Alternatively, if the pressure of the gun is too low, the tunnels formed in the formation may collapse, trapping much of the material in the formation. Further, when the pressure of the gun is too high, equipment (e.g., packers, pump systems, tubing) disposed in the wellbore can be damaged. Thus, by controlling pressure within the gun using example embodiments, the adverse results described above with respect to pressure extremes may be reduced or eliminated.

Example embodiments can be used in shallow wellbores, horizontal wellbores, and/or wellbores with severe curvature. Thus, example embodiments allow for placement of casing pipe in a wider variety of wellbores, reducing costs and improving efficiency. Example embodiments can be used in one or more of a number of different rock formations and using one or more of a number of energetics. Further, by sending a controlled amount of energy to ignite the energetic, the pressure of the gun after igniting the charges can be controlled more precisely.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for controlling pressure in a wellbore during a perforating operation, comprising:

positioning a perforating tool within the wellbore, wherein the perforating tool comprises a gun, an energetic chamber, and a passage disposed within a barrier positioned between the energetic chamber and the gun;

igniting an energetic within the energetic chamber to generate a controlled amount of propellant;

igniting at least one charge within the gun, wherein the at least one charge is ignited toward a wall of the wellbore adjacent to the gun, wherein the at least one charge, when ignited, creates at least one perforation tunnel in the wellbore; and directing the controlled amount of propellant through the passage in the barrier from the energetic chamber into the gun, wherein the controlled amount of propellant is based on conditions in the wellbore, wherein the controlled amount of propellant controls a pressure within the gun after the at least one charge is ignited, wherein the pressure controlled by the controlled amount of propellant controls dynamic forces within the wellbore inside the gun to allow for withdrawal of material from the at least one perforation tunnel while preventing the at least one perforation tunnel from collapsing.

2. The method of claim 1, wherein the energetic is ignited using a control mechanism used to ignite the charge.

3. The method of claim 2, wherein the at least one charge is ignited using a cord disposed in the gun and operatively coupled to the control mechanism.

4. The method of claim 1, wherein the controlled amount of propellant is directed into the gun when the controlled amount of propellant is generated from the energetic.

5. The method of claim 1, wherein a portion of the energetic is ignited using a controlled amount of energy applied to the energetic chamber, wherein the controlled amount of energy is based on a total amount of the energetic in the energetic chamber, wherein the total amount of energetic comprises the portion of the energetic.

6. The method of claim 1, wherein the at least one charge is ignited at a point in time that is substantially the same as when the energetic is ignited.

7. The method of claim 1, wherein the at least one charge is ignited at a point in time that is before when the energetic is ignited.

8. The method of claim 1, wherein the at least one charge is ignited using a cord disposed in the gun and operatively coupled to a first control mechanism, wherein the energetic is ignited by a second control mechanism operatively coupled to the energetic chamber, wherein the second control mechanism delivers a controlled amount of energy to the energetic chamber.

9. A perforating tool, comprising:

a gun comprising at least one charge, wherein the at least one charge is directed radially away from the gun toward a wall of a wellbore, wherein the at least one charge, when ignited, creates at least one perforation tunnel in the wall of the wellbore;

a cord operatively coupled to the at least one charge and to a first control mechanism, wherein the first control mechanism initiates the ignition of the at least one charge using the cord;

an energetic chamber comprising an energetic; and a passage disposed within a barrier positioned between the energetic chamber and the gun, wherein the passage has an open position and a closed position, wherein the passage is in the closed position when the energetic is in a neutral state, wherein the passage is in the open position when the energetic is ignited to generate a controlled amount of propellant, wherein the controlled amount of propellant moves from the energetic chamber to the gun when the passage is in the open position, wherein the controlled amount of propellant is based on conditions in the wellbore, wherein the controlled amount of propellant creates an amount of pressure within the gun after the at least one charge is ignited, wherein the amount of pressure controls dynamic forces in the wellbore in the gun to allow for withdrawal of material from the at least one perforation tunnel while preventing the at least one perforation tunnel from collapsing.

10. The perforating tool of claim 9, wherein the passage comprises a sliding sleeve that slides when the controlled amount of propellant is generated.

11. The perforating tool of claim 9, wherein the passage comprises a rupture mechanism that ruptures when the controlled amount of propellant is generated.

12. The perforating tool of claim 9, wherein the cord is further operatively coupled to the energetic chamber, wherein the cord ignites the energetic to generate the controlled amount of propellant using a fixed amount of energy.

13. The perforating tool of claim 9, wherein the energetic is ignited by a second control mechanism operatively coupled to the energetic chamber, wherein the second control mechanism delivers a controlled amount of energy to the energetic chamber.

14. The perforating tool of claim 13, wherein the controlled amount of energy is based on the amount of pressure to be applied to the gun by the controlled amount of propellant when the energetic is ignited.

15. The perforating tool of claim 9, wherein ignition of the at least one charge has been ignited is independent of ignition of the energetic.

16. The perforating tool of claim 9, wherein a portion of the energetic is ignited using a controlled amount of energy applied to the energetic chamber, wherein the controlled amount of energy is based on a total amount of the energetic in the energetic chamber, wherein the total amount of energetic comprises the portion of the energetic.

17. A perforating system, comprising:

a wellbore disposed within a subterranean formation;

a first control mechanism; and a perforating tool operatively coupled to the first control mechanism and disposed within the wellbore, wherein the perforating tool comprises:

a gun comprising at least one charge, wherein the at least one charge is directed radially away from the gun toward a wall of the wellbore, wherein the at least one charge, when ignited, creates at least one perforation tunnel in the subterranean formation;

a cord operatively coupled to the at least one charge and to the first control mechanism, wherein the first control mechanism initiates the ignition of the at least one charge using the cord;

an energetic chamber comprising an energetic; and a passage disposed within a barrier positioned between the energetic chamber and the gun, wherein the passage has an open position and a closed position, wherein the passage is in the closed position when the energetic is in a neutral state, wherein the passage is in the open position when the energetic is ignited to generate a controlled amount of propellant, wherein the controlled amount of propellant moves from the energetic chamber to the gun when the passage is in the open position, wherein the controlled amount of propellant is based on conditions in the wellbore, wherein the controlled amount of propellant creates an amount of pressure within the gun after the at least one charge is ignited, wherein the amount of pressure controls dynamic forces in the wellbore within the gun to allow for withdrawal of material from the at least one perforation tunnel while preventing the at least one perforation tunnel from collapsing.

18. The perforating system of claim 17, further comprising:

a second control mechanism operatively coupled to the energetic chamber, wherein the second control mechanism is used to ignite the energetic.

19. The perforating system of claim 17, wherein the controlled amount of propellant increases a pressure within the gun after the at least one charge has been ignited.

20. The perforating system of claim 17, wherein the controlled amount of propellant is generated by at least one selected from a group consisting of (i) igniting a portion of the energetic using a controlled amount of energy applied to the energetic chamber, wherein the controlled amount of energy is based on a total amount of the energetic in the energetic chamber, wherein the total amount of energetic comprises the portion of the energetic, and (ii) igniting the energetic within the energetic chamber using a first control mechanism, wherein the at least one charge in the gun is ignited using a second control mechanism.

* * * * *